United States Patent [19]

Volland

[11] 4,260,933

[45] Apr. 7, 1981

[54] SELECTIVE FREQUENCY OPTICAL GENERATOR

[76] Inventor: Jerry Volland, P.O. Box 8061, Boise, Id. 83707

[21] Appl. No.: 102,244

[22] Filed: Dec. 10, 1979

[51] Int. Cl.[3] ..... H01J 17/36

[52] U.S. Cl. ..... 315/326; 55/139; 315/227 R; 315/244; 331/184

[58] Field of Search ..... 315/227 R, 58, 71, 244, 315/246, 326; 55/139, 152; 331/184; 328/250, 251

[56] References Cited

U.S. PATENT DOCUMENTS

| | | | |
|---|---|---|---|
| 1,861,621 | 6/1932 | Buttolph | 315/58 |
| 2,482,773 | 9/1949 | Hieronymus | 324/300 X |
| 3,781,601 | 12/1973 | Imris | 315/227 R |

*Primary Examiner*—Eugene R. LaRoche
*Attorney, Agent, or Firm*—Paul F. Horton

[57] ABSTRACT

An optical generator of an electrostatic field at light frequencies tuneable over the entire band of visible light frequencies including a pair of spaced electrodes in a gas filled tube having at least one absolute condenser plate adjacent one electrode, a dielectric-filled container enclosing the tube, and a resonant circuit operable to generate electric light of a selected frequency.

4 Claims, 3 Drawing Figures

SELECTIVE FREQUENCY OPTICAL GENERATOR

BACKGROUND OF THE INVENTION

1. Field of the Invention

This invention relates to optical generators and, more particularly, to circuits utilizing tuneable optical generators of electrostatic fields at selected light frequencies.

2. Description of the Prior Art

The desirability of generating an electrostatic field at light frequencies has long been recognized. The increase in efficiency of electrical circuits containing such a generator is noted in U.S. Pat. No. 3,781,601 issued to P. Imris. While the Imris invention represents a very real advancement in the art, the Imris device provides generation of only a wide band of frequencies over the light spectrum. It is often desirable, for many reasons, to utilize an electrostatic field at a selected light frequency in an electrical circuit, as noted in U.S. Pat. No. 2,482,773 issued to T. G. Hieronymus. Such uses include not only increased efficiency of an electrical circuit at a particular light frequency, but generation of selected frequencies for non-power load purposes including the general fields of photography and optical and solid state physics, as well as selective ionization.

SUMMARY OF THE INVENTION

The present invention provides an optical generator which is tuneable to a selected frequency and visible light band. A more comprehensive description may be found in the appended claims.

It is therefore a primary object of the present invention to provide an improved optical electrostatic generator operable at a selected frequency.

It is a further object of the present invention to provide electrostatic oscillations at light frequency for use in external circuits.

These and additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
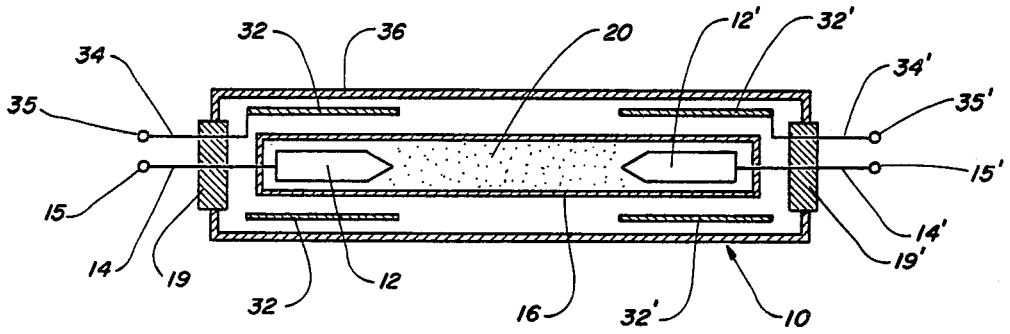
FIG. 1 is a diagram of the optical generator of the present invention shown in cross section.

Referring now to FIG. 1, an embodiment to be preferred of the optical electrostatic generator made in accordance with the present invention is disclosed. Optical generator 10 includes a pair of electrodes 12 and 12' equipped with conductors 14 and 14', respectively extending to the exterior of the generator to define exterior terminals 15 and 15', respectively. The spaced, preferably tungsten, electrodes are surrounded and enclosed by a glass, preferably quartz, envelope 16 containing a suitable ionizeable gas 20, conventional in the art. Condensers 32 and 32' are outwardly spaced from envelope 16 and from electrodes 12 and 12', respectively, contained therein. Conductors 34 and 34' extend from condensers 32 and 32', respectively to the exterior of the generator, defining external terminals 35 and 35' respectively. A metallic enclosure 36 surrounds and encloses all components of the generator except external conductors as heretofore mentioned.

Conductors 14 and 14' leading from electrodes 12 and 12', respectively are routed through insulators 19 and 19', respectively which serve to electrically shield the conductors and hence the attached electrodes from the enclosing condensers and metallic enclosure. In this manner an absolute condenser, as opposed to a relative condenser, is formed between the condenser caps and the adjacent electrode and ionized gas within the discharge envelope 16. The term "absolute" as used herein defines a condenser wherein a dielectric is imposed between the two or more plates forming the condenser, without a physical short circuit between the plates. Conductors 34 and 34' are similarly routed through insulators 19 and 19', respectively or the like.

Figure 2:
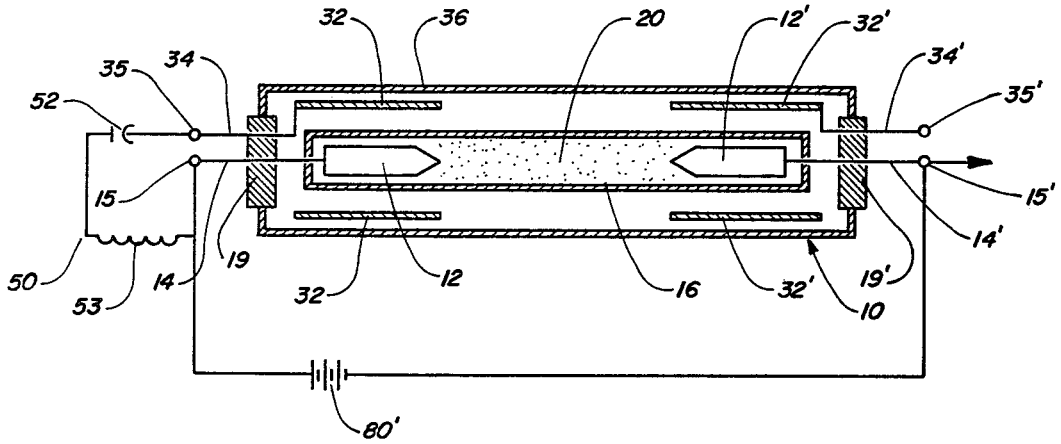
FIG. 2 is a diagram of the optical generator of the present invention including a resonant circuit and showing use in a low voltage circuit.
Figure 3:
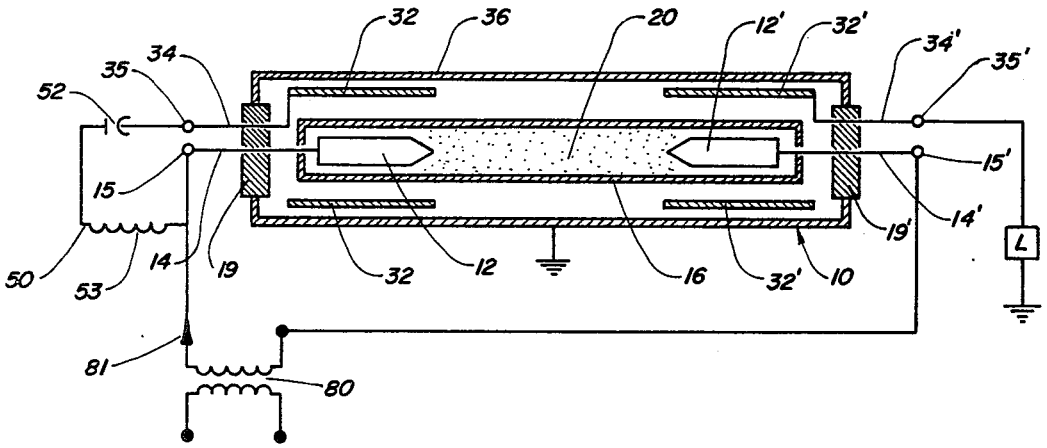
FIG. 3 is a diagram of the optical generator of the present invention including a resonant circuit and showing use in a high voltage circuit.

Referring now to FIGS. 2 and 3, resonant circuits 50 extending between terminals 15 of electrode 12 and terminal 35 connected to condenser cap 32 is shown to advantage. Resonant circuits 50 include the conventional elements of the capacitor 52 and an inductor 53. While conventional types of capacitors and inductors are not excluded, it is preferred that a resmod type geometry as suggested in Defense Nuclear Agency Report 4417T, September, 1977, be used for the inductance and capacitance of this invention. For this purpose, a minature sphere or cone with spaced rod, not shown, may be used. For high voltage circuits, the circuitry as shown in FIG. 3 is preferred. This circuitry preferably includes a direct current source.

In operation, direct current is produced from either a transformer 80 in combination with a rectifier 81 or by means of a battery 80'. The current, flowing through the circuitry from, for example, electrode 12 to electrode 12' ionizes gas 20 contained within discharge envelope 16. A potential difference is thereby created between condenser caps 32 and 32', respectively and the gas and electrodes contained within the discharge envelope. An oscillation effect occurs between condenser cap 32 serving as one plate of a condenser and electrode 12 and ionized gas 20 serving as the other plate of the condenser and similarly between condenser cap 32' and electrode 12' including gas 20. The oscillating current flow has a frequency as determined by the capacitance and inductance values of resonant circuit 50. In this manner an electrostatic field at selected light frequencies is produced. Output may be obtained either at output terminal 35' or 15', as desired. FIG. 3 shows use of the generator in an electrical circuit for photolysis, as in the photo dissociation of water. The load L, in this example, would consist of an electrode immersed in water contained within a grounded reservoir.

Having thus described in detail a preferred selection of embodiments of the present invention, it is to be appreciated and will be apparent to those skilled in the art that many physical changes could be made in the apparatus without altering inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A tuned optical generator of an electrostatic field at light frequencies in electrical circuitry, said generator comprising:

a gaseous discharge tube including at least two spaced electrodes, an enclosing light-permeable envelope and an ionizable gas contained therein;

at least one absolute condenser plate adjacently spaced from one of said electrodes;

an electrically conductive casing surrounding said tube;

a dielectric between said tube and said casing; and means electrically connected between at least one of said electrodes of said gaseous discharge tube and one of said adjacent condenser plate for passing electrostatic oscillations of predetermined light frequency.

2. Apparatus as described in claim 1 wherein said means for passing an oscillating electrostatic field of predetermined frequency includes a resonant electrical circuit.

3. Apparatus as described in claim 2 wherein said resonant electrical circuit includes inductance means and capacitance means electrically located between at least one of said electrodes and an adjacent condenser plate.

4. A tuned optical generator of an electrostatic field at light frequencies in electrical circuitry, said generator comprising:

a gaseous discharge tube including two spaced electrodes, an enclosing light permeable envelope and an ionizing gas contained therein;

a pair of absolute condenser plates, each plate adjacently spaced outwardly from one of said electrodes;

an electrically conductive casing surrounding said tube and spaced outwardly adjacent said absolute condenser plates;

a dielectric between said tube and said casing; and a resonant frequency electrical circuit including resmod-type geometry means connected to at least one of said electrodes or its adjacent absolute condenser plate.

* * * * *